US006782926B1

(12) United States Patent
Hughes

(10) Patent No.: US 6,782,926 B1
(45) Date of Patent: Aug. 31, 2004

(54) CLOSED-LOOP REFILLING AND PRESSURE TESTING SYSTEM FOR MODERN MOTOR VEHICLE COOLING SYSTEMS

(76) Inventor: Randall L. Hughes, 3916 Daisy Pl., Oceanside, CA (US) 92056

( * ) Notice: Subject to any disclaimer, the term of this patent is extended or adjusted under 35 U.S.C. 154(b) by 0 days.

(21) Appl. No.: 10/397,437

(22) Filed: Mar. 25, 2003

(51) Int. Cl.[7] ..... B65B 1/04

(52) U.S. Cl. ..... 141/98; 141/59; 141/65; 184/1.5

(58) Field of Search ..... 141/59, 65, 66, 141/67, 98; 184/1.5; 134/168 C, 168 R, 169 R, 169 A, 169 C, 184

(56) References Cited

U.S. PATENT DOCUMENTS

| | | | |
|---|---|---|---|
| 2,029,232 | A | 1/1936 | Green |
| 2,187,413 | A | 1/1940 | Boezi et al. |
| 2,222,516 | A | 11/1940 | Powell |
| 2,632,719 | A | 3/1953 | Tankersley |
| 3,094,131 | A | 6/1963 | Williams |
| 3,188,006 | A | 6/1965 | Flak |
| 4,083,399 | A | 4/1978 | Babish et al. |
| 4,109,703 | A | 8/1978 | Babish et al. |
| 4,127,160 | A | 11/1978 | Joffe |
| 5,390,636 | A | 2/1995 | Baylor et al. |
| 5,425,333 | A | 6/1995 | Baylor et al. |
| 5,511,590 | A | 4/1996 | Turcotte |
| 5,540,327 | A | 7/1996 | Creeron |
| 5,573,045 | A | 11/1996 | Akazawa |
| 5,586,583 | A | 12/1996 | Edwards |
| 5,950,695 | A | 9/1999 | Smith |
| 5,992,481 | A | 11/1999 | Smith |
| 6,082,416 | A | 7/2000 | Viken |
| 6,152,193 | A | 11/2000 | Klamm |
| 6,164,346 | A | 12/2000 | Viken |
| 6,193,895 | B1 | 2/2001 | Dea et al. |
| 6,213,175 | B1 | 4/2001 | Rome |
| 6,233,790 | B1 | 5/2001 | Carothers |
| 6,234,215 | B1 | 5/2001 | Klamm |
| 6,360,790 | B1 | 3/2002 | Klamm |
| 6,360,791 | B2 | 3/2002 | Rome |

OTHER PUBLICATIONS

US 2002/0148529 A1: Berndorfer et al.; Oct. 17, 2002.*
US 2002/0148686 A1; Yun et al.; Oct. 17, 2002.*
US 2001/0032754 A1; Bedi et al.; Oct. 25, 2001.*
US 2003/0205432 A1; Mills et al.; Nov. 06, 2003.*

* cited by examiner

*Primary Examiner*—Gregory L. Huson
*Assistant Examiner*—Khoa D. Huynh
(74) *Attorney, Agent, or Firm*—Donn K. Harms

(57) ABSTRACT

A compact, hand carryable, closed-loop refilling, purging, and pressure testing device adapted for use liquid motor vehicle cooling systems. The disclosed device performs the full range of filling, removal of gasses and contaminants, and pressure testing, in a small unit that can sit on a workbench or the floor to perform the tasks. The device requires no removal or possible damage to any of the hose connections of the cooling system. Another advantage is the limitation of accidental spillage or leakage of the antifreeze fluid into the environment due to the closed nature of the system. Additionally, utility is provided by a surging and unloading valve which causes system fluid to surge toward an exit upon reaching a designated pressure, thereby purging gas from the cooling system by carrying it along in such surges.

20 Claims, 3 Drawing Sheets

CLOSED-LOOP REFILLING AND PRESSURE TESTING SYSTEM FOR MODERN MOTOR VEHICLE COOLING SYSTEMS

FIELD OF THE INVENTION

This invention relates to the field of motor vehicle service, more specifically to the filling and pressure testing of the cooling systems of motor vehicles. The cooling system of a motor vehicle or automobile basically consists of a radiator, motor and the heater core connected by the means of hoses, filled with varying proportions of water and antifreeze liquid, depending upon the climate. Periodic maintenance recommended by the manufacturers requires that the cooling system of all motor vehicles be drained and refilled with fresh fluid.

This invention provides a compact lightweight means to perform these maintenance functions quickly and easily along with removing entrapped air, without the intrusive measures of removing any interconnecting hoses within the system and allowing the excess fluid to return to the container. After connections of hoses have been removed by a service person, no matter how old the vehicle it becomes debatable if any damage to the hoses was done at the time of the removal and who should be responsible for the replacement of the hoses and any other damage incurred when the hoses fail.

BACKGROUND OF THE INVENTION

Since the advent of the motor vehicle the means of cooling the motor has been a radiator filled with water and interconnected by means of rubber hoses. The heater for the inside of the motor vehicle is coupled with this cooling system with additional rubber hoses to the heater core. The connection of the rubber hoses and the associated parts of the cooling system is commonly made by slipping the rubber hose over a nipple section and affixing a hose clamp over the rubber hose at the union. Early on, antifreeze, composed of ethylene glycol, was developed to inhibit rust and corrosion and to prevent freeze-up and boil over. From the start manufacturers have recommended periodic draining, flushing and refilling of the cooling system, but too often this involved the removal of the radiator because of some form of blockage. There have been a great number of patents issued for machines to perform the task of draining and flushing motor vehicle cooling systems but they are large, cumbersome and require an electrical connection. If the radiator was blocked in any way, it would have to be removed and the core rodded out. Much of the failure in the cooling systems has been caused by the deterioration and contamination of the liquid coolants, causing blockage of the radiator and overheating of the engine with the small ports in a radiator, if there is an appreciable amount of debris in the fluid, more often than not the flushing process will offer only a temporary solution to the problem, and the radiator will soon have to be removed and rodded out.

In the last ten years there has been a noticeable and profound improvement in the reliability of automobile cooling systems. Rarely is a cooing system failure caused by deteriorated or contaminated coolant. This is mainly due to the improved quality of automotive antifreeze, the addition of the radiator overflow tank, and the conscientious maintenance habits of automobile owners.

As most automobile cooling systems are simple to refill after draining for routine servicing or repairs, they do require the technician's full attention until the cooling system is completely full and the air is bled out through the radiator filler neck. Depending on the make and model of the automobile, this procedure can take between ten to thirty minutes, as the coolant temperature has to be hot enough to open the thermostat, allowing trapped air to escape up to the radiator to be bled off.

Design changes to automobiles have made servicing cooling systems much more difficult and time consuming with some examples being the automobile with a rear engine and the radiator in the front, the radiator with the restricted filling neck, the limited access to the filling neck and the filling neck below the high point of the cooling system. Improperly filled cooling systems can cause engine overheating and damage.

U.S. Pat. No. 4,083,399 of John A. Babish et al. describes an improved flushing apparatus that employs the combination of forces of controlled pressurized water and air turbulence to effect efficient flushing and cleaning of internal combustion engine liquid cooling systems. The '399 Babish patent tells of a large machine with many controls and functions to drain and flush radiators, it would take up a good deal of space in a shop for a flushing operation that is not used as often as in the past and involves disconnecting existing cooling system hoses at various locations.

U.S. Pat. No. 4,109,703 of John A. Babish et al. relates to flushing of internal combustion engine liquid cooling systems; more particularly, it concerns an air pressure assisted flushing of such systems wherein air bubbles entrained in flushing liquid act to efficiently scavenge or scrub scale and rust from coolant passages. The '703 patent of Babish is a modification of his first patent and still involves a large machine and involves the cutting and permanently installing fittings for the operation in the rubber hoses of the cooling systems of the automobiles.

U.S. Pat. No. 4,127,160 of Kenneth L. Joffe discloses a method and apparatus for flushing debris from a liquid circulation system such as the cooling system of a water-cooled vehicle. The apparatus includes an inlet conduit for flushing liquid, a series of branch conduits connected to points on the circulation system, a drainage conduit for used water, and a valve or series of valves setable between various positions dictating different flow paths for the flushing liquid through the conduits and the circulation system. The '160 patent of Joffe is another large device that entails several connections within the circulation system of the engine involving more time to set up and the possibility of damaging the rubber hoses in the system.

SUMMARY OF THE INVENTION

The preferred embodiment of this invention consists of a closed-loop refilling and pressure testing system for modern motor vehicle cooling systems comprised of a fluid reservoir with the fill cap incorporating an air release valve. A mounting plate with the handle is attached to the top of the fluid reservoir tank by the means of conventional fasteners and is the base plate whereby all the controls and connections are attached. On the top surface of the mounting plate are: the compressed air fitting, the external hose quick disconnect coupling, a 3-way valve control knob, the line pressure gauge, the return hose connection fitting and the delivery hose connection fitting. The delivery hose with the in-line flow control valve is connected to the nipple on the top of the radiator fill cap adapter. The return hose is connected to the radiator tank overflow nipple on the radiator fill spout of the radiator.

With the 3-way valve control knob in the first position, compressed air enters the compressed air fitting to the compressed air regulator to drive the pneumatic pump. The motor vehicle will have been running long enough to heat the existing antifreeze in the cooling system and the thermostat will be open to allow free flow of the coolant through the system. The pneumatic pump draws the antifreeze fluid through a strainer and pressurizes it to flow through the delivery hose and the flow control valve to the nipple on top of the radiator fill cap adapter. The pressurized antifreeze fluid then passes through the normal channels of the motor vehicle cooling system, consisting of the radiator top tank, the radiator core, the radiator lower tank, the motor and the heater core before returning back through the motor, where it may be somewhat restricted by the thermostat before returning back to the radiator top tank. Various combinations of different routings occur on different makes of vehicles with the same general basic principles involved. Under normal operation of the vehicle the heated antifreeze fluid flows freely through the motor vehicle cooling system with the gasses or expanded fluids passing through the radiator tank overflow nipple through a hose and into a conventional overflow tank. Excess antifreeze fluid and any accumulated gasses displaced by the antifreeze fluid are transferred back to the fluid reservoir tank by the means of the return hose connected to the nipple on the radiator fill spout. The return hose connects to the return hose connection fitting with the antifreeze fluid flowing through the interconnecting tubing into the entrance port of the 3-way valve and out the primary exit port into the fluid reservoir. The secondary exit port of the 3-way valve is closed during this operation With the motor vehicle cooling system filled with antifreeze fluid and most of the accumulated gasses removed, the 3-way valve control knob is turned to the second position. At this position the primary exit port of the 3-way valve is closed and the secondary exit port is opened to allow the flow of the antifreeze fluid into the surging unloading valve where the valve holds back the antifreeze fluid until a predetermined pressure is reached; then it releases the fluid in a substantially instantaneous surge until the pressure is lost. Thereafter the surging and unloading valve resets and begins to hold back and build the pressure again to the predetermined level wherein the cycle repeats itself. This surging action has the unique capability of making the fluid in the system draw or pull along the entrapped gasses within the motor vehicle cooling system and transferring them into the fluid reservoir central cavity. This is especially effective in fluid cooled engines since there are many nooks and crannies in which gas becomes trapped and held in place by the fluid, and using that fluid to draw out the gas or air during fluid surging helps to void the cooling system of gas which inhibits its operation. Also, the slow building of the surging and unloading valve of the system pressure and sudden release thereof stores energy in the flexible hoses used in such systems which is also released when the valve suddenly opens aiding in the purging of the system of gas.

After operating the closed-loop refilling and pressure testing system for modern motor vehicle cooling systems for a predetermined amount of time, the 3-way control knob is turned to the third position with both the primary exit port and the secondary exit port on the 3-way valve closed. In this position the motor vehicle cooling system can be pressure tested by reading the line pressure gauge. Also, with the 3-way valve in this position a hose can be attached to the external hose coupling connected to interconnecting tubing to transfer antifreeze and entrapped gasses into a secondary containment means out of the closed loop system.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent construction insofar as they do not depart from the spirit and scope of the present invention.

An object of this closed-loop refilling and pressure testing system for modern motor vehicle cooling systems is to provide a means to refill and pressure test the cooling systems of motor vehicles, especially the modern variety with a filling means lower than some parts of the engine allowing for the entrapment of air within the system.

Another object of this closed-loop refilling and pressure testing system for modern motor vehicle cooling systems is to return any excess fluid back to the fill tank along with the entrapped air.

An additional object of this closed-loop refilling and pressure testing system for modern motor vehicle cooling systems is to create a pulsating force to remove entrapped air, gas, or solid contaminants, from the system.

A further object of this closed-loop refilling and pressure testing system for modern motor vehicle cooling systems is to refill and pressure test motor vehicles with the radiators in remote locations from the engines, as when the engine is in the rear and the radiator is in the front of the vehicle.

Yet another object of this closed-loop refilling and pressure testing system for modern motor vehicle cooling systems is to refill and pressure test vehicles with limited access to the filling neck of the radiator.

A further object of this closed-loop refilling and pressure testing system for modern motor vehicle cooling systems is to supply a device small and lightweight enough to rest on top of any work bench during the process and can be easily stored.

Still another object of this closed-loop refilling and pressure testing system for modern motor vehicle cooling systems is to supply a device that can operate with air pressure alone, not requiring an electrical hook-up.

Yet another object of this closed-loop refilling and pressure testing system for modern automotive cooling systems is to perform the operations quickly and efficiently without removing any existing hose connections on the vehicle.

These together with other objects and advantages which will become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figure 1:
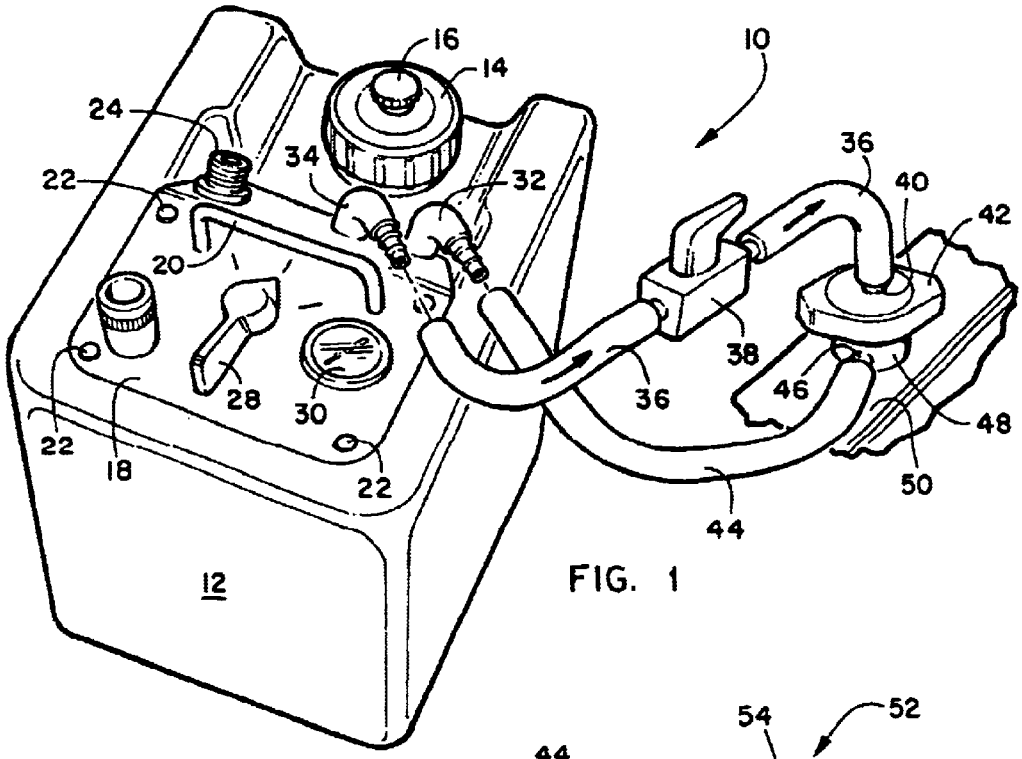
FIG. 1 depicts a perspective view of the closed-loop refilling and pressure testing system for modern motor vehicle cooling systems.

Referring now to the drawings, wherein similar parts of the invention are identified by like reference numerals, there is seen in FIG. 1 a perspective view of the closed-loop refilling and pressure testing system for modern motor vehicle cooling systems as device 10 comprised of the fluid reservoir tank 12 with the fill cap 14 incorporating an air release valve 16 as a means to vent pressure from the reservoir tank 12. Mounting plate 18 with the handle 20 is shown attached to the fluid reservoir tank 12 by the means of conventional fasteners 22 and the mounting plate 18 whereby all the controls and connections are attached. An air gap between the mounting plate 18 and its attachment to the reservoir tank 18 can also be provided and function as an air release for the device and in that case the air release valve 16 would not be needed to vent the reservoir tank 12.

On the top surface of the mounting plate 18 are the compressed air fitting 24, the external hose quick disconnect coupling 26, 3-way valve control knob 28, a line pressure gauge 30, the return hose connection fitting 32 and the delivery hose connection fitting 34. Also illustrated in FIG. 1 are the delivery hose 36 with the in-line flow control valve 38 with the second section of the delivery hose 36 connected to the nipple 40 on the top of the radiator fill cap adapter 42. The return hose 44 is shown connected to the radiator tank overflow nipple 46 on the radiator fill spout 48 of the radiator 50.

Figure 2:
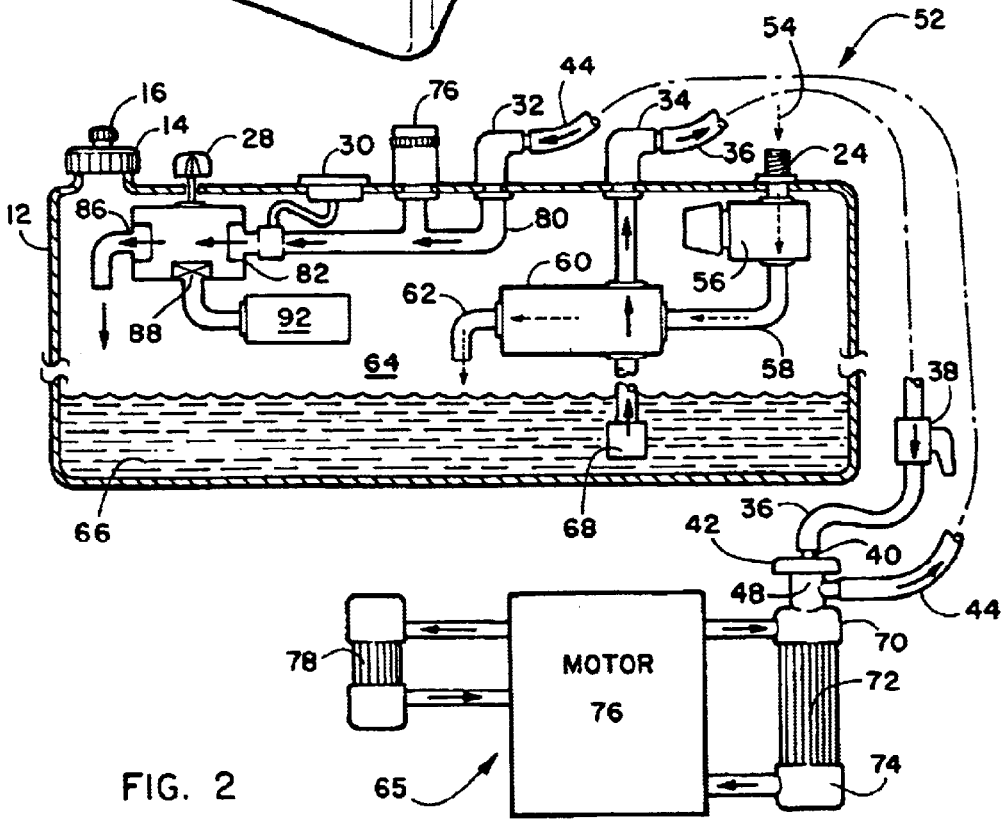
FIG. 2 depicts a schematic flow diagram of a section through the side of the closed-loop refilling and pressure testing system for modern motor vehicle cooling systems in a first position.

FIG. 2 depicts a schematic flow diagram of a section through the side of the closed-loop refilling and pressure testing system for modern motor vehicle cooling systems 52 with the 3-way valve control knob 28 in the first position thereby forming a first fluid path. Forced air 54 from a compressed air source enters the compressed air fitting 24 and through the compressed air regulator 56 then through air line 58 to drive the pneumatic pump 60 exhausting the spent forced air through air exhaust port 62 into the fluid reservoir central cavity 64. The motor vehicle will have been running long enough to heat the existing antifreeze in the motor vehicle cooling system 65 and the thermostat will be open to allow free flow of the coolant through the system. The pneumatic pump 60 is the current best means for providing fluid pressure to the system because conventionally pneumatic pumps pressurize the pumped fluid at the same pressure as the pressurized air driving them. Thus, the user can vary the pressure of the pressurized air 54 and thereby easily vary the fluid pressure.

The pneumatic pump 60 draws the antifreeze fluid 66 through a strainer 68 and pressurizes it to flow through the delivery hose 36 and the flow control valve 38 to the nipple 40 on top of the radiator fill cap adapter 42. The pressurized antifreeze fluid 66 then passes through the normal channels of the motor vehicle cooling system 68 consisting of the radiator top tank 70, the radiator core 72, the radiator lower tank 74, the motor 76 and the heater core 78 before returning back through the motor 76 where it may be somewhat restricted by the thermostat before returning back to the radiator top tank 70. Various combinations of different routings occur on different makes of vehicles with the same general basic principles involved. Under normal operation of the vehicle the heated antifreeze fluid 66 flows freely through the motor vehicle cooling system 65 with the gasses or expanded fluids passing through the radiator tank overflow nipple 46 through a hose and into a conventional overflow tank.

FIG. 2 further illustrates the excess antifreeze fluid 66 and any accumulated gasses displaced by the antifreeze fluid 66 being transferred back to the fluid reservoir tank 12 by the means of the return hose 44 connected to the nipple 46 on the radiator fill spout 48. The return hose 44 connects to the return hose connection fitting 32 with the antifreeze fluid 66 flowing through the interconnecting tubing 80 into the entrance port 82 of the 3-way valve 84 and out the primary exit port 86 into the fluid reservoir central cavity 64. The secondary exit port 88 is closed during this operation.

Figure 3:
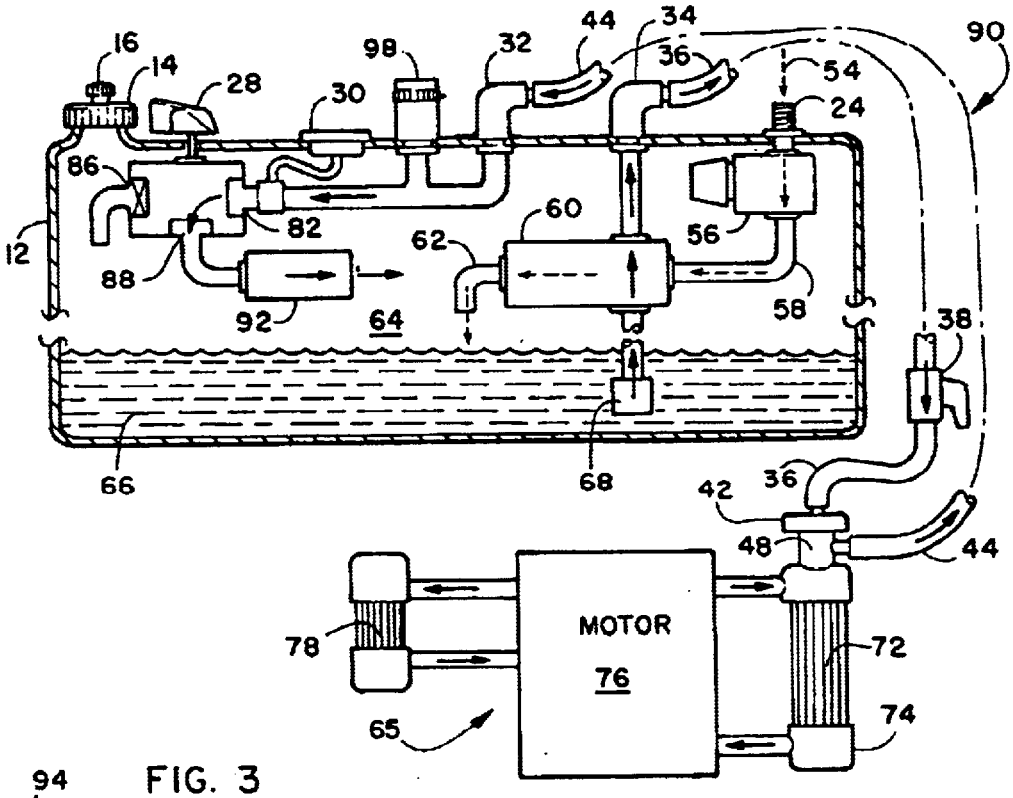
FIG. 3 depicts a schematic flow diagram of a section through the side of the closed-loop refilling and pressure testing system for modern motor vehicle cooling systems in a second position.

With the motor vehicle cooling system 65 filled with antifreeze fluid 66 and most of the accumulated gasses removed through fluid flow, the 3-way valve control knob 28 is then turned to the second position illustrated in FIG. 3 depicting a schematic flow diagram of a section through the side of the closed-loop refilling and pressure testing system for modern motor vehicle cooling systems 90. At this position the primary exit port 86 of the 3-way valve 84 is closed and the secondary exit port 88 is opened to allow the flow of the antifreeze fluid 66 through the surging unloading valve 92 where the valve holds back the system coolant fluid such as antifreeze fluid 66 until a predetermined pressure is reached. At that pressure point, the unloading valve 92 releases the fluid in a substantially instantaneous surge, until the system pressure is lost, wherein the surging and unloading valve 92 begins to hold back the fluid again and pressurizing the system until the predetermined pressure point is reached again, wherein the surging unloading valve 92 again will substantially instantaneously depressurize the system causing a surge of fluid.

Figure 5:
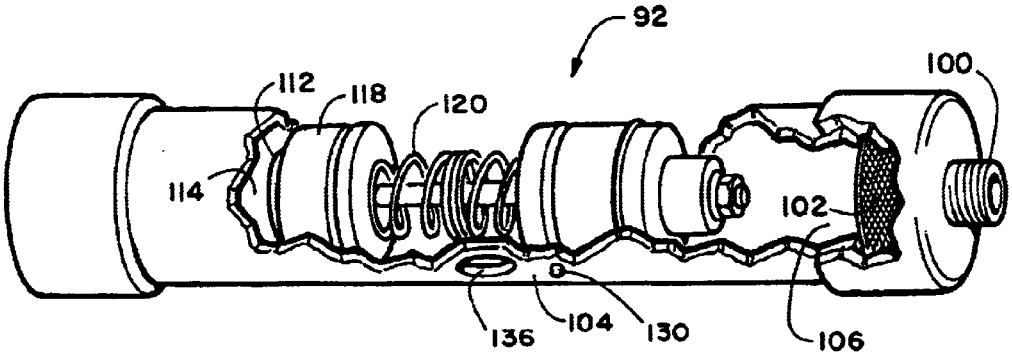
FIG. 5 is a side exploded of the unloading valve used to cause system fluid to pressurize and surge on release to dislodge gas from the system.
Figure 6:
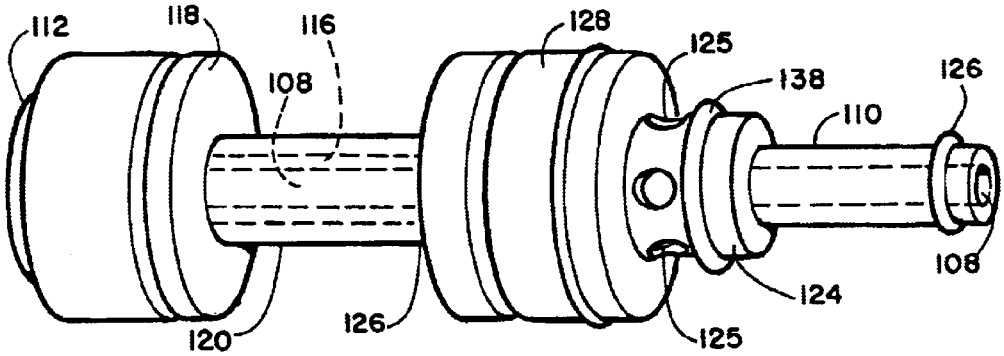
FIG. 6 depicts the internal parts of the surging unloading valve.
Figure 7:
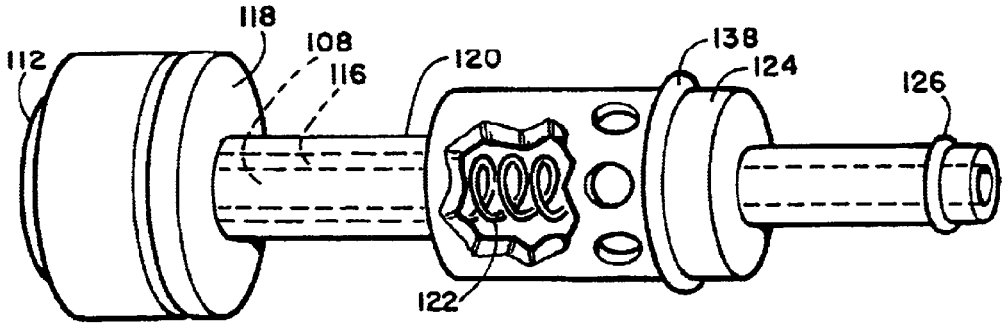
FIG. 7 shows the internal part of FIG. 6 with a component removed to show a second spring.

This surging action provides the device the capability of drawing the entrapped gasses or bubbles trapped within the motor or engine cooling system 65, out of the system and transferring them into the fluid reservoir central cavity 64. This is especially helpful for both purging the system of air and gas and for conducting a preliminary pressure test, since leaks at the pressure under the point of surge will appear where they can be fixed but will cease once the unloading valve 92 releases in the surge of depressurization. This surging valve 92 provides a means to build system pressure to a predetermined level and then release the pressure substantially instantaneously to thereby dislodge gas bubbles and solid contaminants which might be trapped in high elevation areas or in internal cooling system cavities, allowing the system to vent trapped gas and solids that would otherwise be left in the system. The surging valve 92 in the current best mode takes about two to three seconds to build the pressure in the system to the point where the surging valve 92 equals the predetermined pressure point whereby it substantially instantaneously releases system pressure allowing the fluid and contaminants to surge out of the cooling system. As shown in FIGS. 5–7, this embodiment of a surging valve 92 is mechanical and simple in operation, and while an electronic valve might serve the same means to build system pressure to a predetermined level and then release the pressure substantially instantaneously, for simplicity of operation, the depicted valve works very well and keeps the system simple and not dependent on electrical, power.

As shown in FIGS. 5–7, returning coolant from the vehicles cooling system communicates through the hose connector 100 and through an optional strainer 102 and fills and pressurizes the upper chamber 106 defined at one end of the valve housing 104 of the surging valve 92. As the fluid fills the upper chamber 106, pressure builds in that chamber and causes fluid to travel through the central passage 108 of the plunger tube 110 where it is forced past a flap valve 112 and into the lower chamber 114. As fluid pressure builds in the lower chamber 114, the plunger 118 and plunger tube 116 are forced toward the upper chamber 106 thereby overcoming the bias force of the pressure control spring 120. As the plunger 118 continues toward the upper chamber 106, the valve release collar 120 pushes the valve release spring 122 against the bottom portion of the valve 124. When coolant pressure in the upper and lower chambers reach the predetermined pressure which currently is substantially 11 to 17 pounds per square inch, sufficient force will be exerted on the valve 124 by the valve release spring 122 to overcome the bias from the pressure in the upper chamber which holds the valve 124 in a closed position shown in FIG. 5. The valve 124 will now substantially instantaneously move to an open position best shown in FIG. 6 resting against a retaining ring 126.

In the open position, pressurized coolant occupying the upper chamber 106 is vented through apertures 125 in the valve 124 into a center portion of the valve housing 104 and exits the housing 104 through a discharge port 136, wherein pressure in the upper chamber 106 moves substantially to zero for a short period of time. Concurrently, the pressure from the pressure control spring 120 on the plunger 118 forces it toward the lower chamber 114 and residual fluid from the lower chamber 114 passes through a small orifice in the flap valve 112 and into the center passage 108 where it is communicated to the discharge port 136.

As the plunger 118 moves back toward the lower chamber 114, the valve 124 is pulled toward the lower chamber 114 and back onto a sealed engagement with the valve housing 128 which is held in a static position by pin 130 and in sealed engagement with the retainer O ring 138 thereby cutting off the apertures 125 from draining and sealing the upper chamber 106 wherein the cycle starts again.

In the current best mode of the device herein disclosed, this unloading valve 92 is as such highly desirable to remove air and gas and solid contaminants from the system by dragging them from the interior coolant passages when the fluid pressure builds and surges on release. The surging valve 92 also provides means to pressure test the cooling system by pressurizing the system to the predetermined point just before release, expanding the hoses for the system that store energy for the surge, and thereby to check for leaks from those hoses and gaskets of the system normal system pressures. This second fluid path could be used by itself in a device with no three way valve and still be a vast improvement on conventional cooling system filling and purging systems and such is anticipated; however, the best mode of the device has all three fluid paths to give the user more choice and utility in their filling and purging cooling systems.

Figure 4:
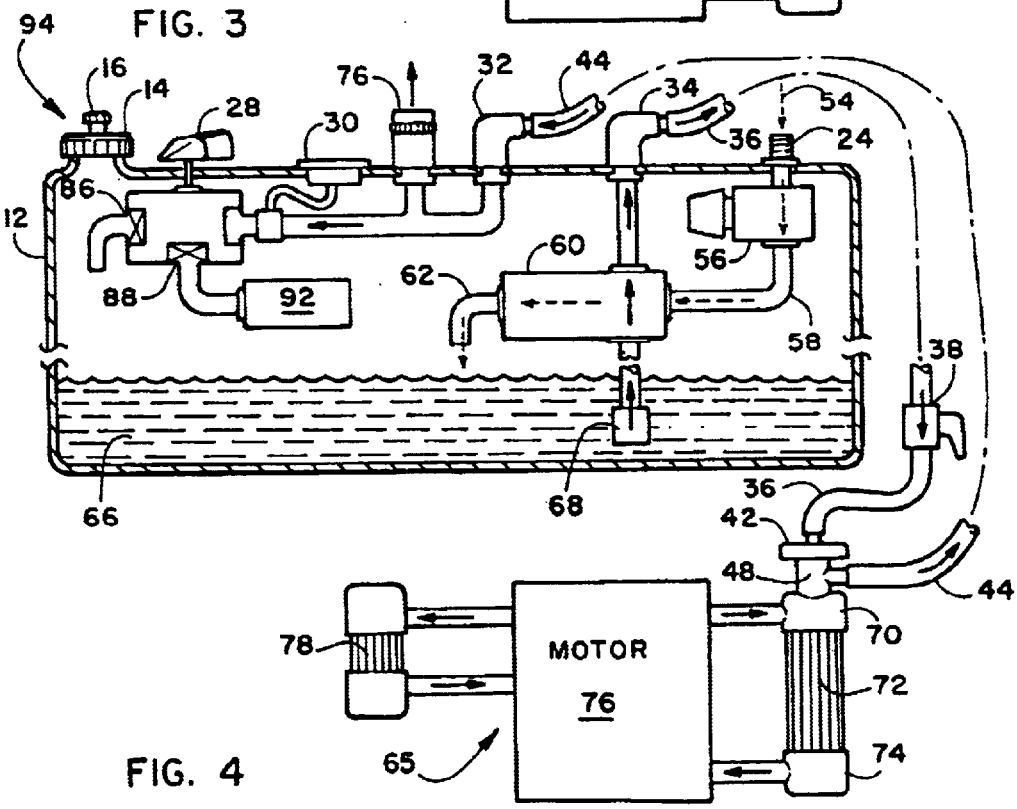
FIG. 4 depicts a schematic flow diagram of a section through the side of the closed-loop refilling and pressure testing system for modern motor vehicle cooling systems in a third position.

After operating the closed-loop refilling and pressure testing system for modern motor vehicle cooling systems 90 for a predetermined amount of time, the 3-way control knob 28 is turned to the third position illustrated in FIG. 4, depicting a schematic diagram of a third fluid path shown as a section through the side of the closed-loop refilling and pressure testing system for modern motor vehicle cooling systems 94 with both the primary exit port 86 and the secondary exit port 88 on the 3-way valve 84 closed. In this position the motor vehicle cooling system 65 can be pressure tested by reading the line pressure gauge 96 connected to the interconnecting tubing 80 and allowing the pressure to rise in the system as the pump injects fluid and the hoses expand. Also, with the 3-way valve 84 in this position a hose can be attached to the external hose coupling 98 connected to the interconnecting tubing 80 to transfer antifreeze and entrapped gasses into a secondary containment means out of the closed loop system. This third fluid path also allows the venting of contaminated fluid from the cooling system to an exterior container thereby preserving the clean fluid in the reservoir.

The device herein shown in the drawings and described in detail herein disclose arrangements of elements of particular construction and configuration for illustrating preferred embodiments of structure and method of operation of the present invention. It is to be understood, however, that elements of different construction and configuration and other arrangements thereof, other than those illustrated and described, may be employed for providing a fluid refilling and pressure testing system for modern motor vehicles in accordance with the spirit of this invention. Further, some components and/or fluid circuits provided by the device might be used without others and still yield a significant performance and utility increase over current devices for such a purpose. All such changes, alternations and modifications as would occur to those skilled in the art are considered to be within the scope of this invention as broadly defined in the appended claims.

As such, while the present invention has been described herein with reference to particular embodiments thereof, a latitude of modifications, various changes and substitutions are intended in the foregoing disclosure, and it will be appreciated that in some instance some features of the invention will be employed without a corresponding use of other features without departing from the scope of the invention as set forth in the following claims.

What is claimed is:

1. A fluid refilling and pressure testing apparatus for filling and pressure testing cooling systems comprising:

a first fluid circuit, said first fluid circuit comprising:

a delivery conduit adapted at a first end for sealed engagement with the pressurized coolant fluid circuit of an internal combustion engine;

said delivery conduit in sealed communication at a second end with a fluid supply;

means to pressurize said fluid supply communicated to said second end of said delivery conduit;

a return conduit adapted at a first end for sealed communication with said coolant fluid circuit;

said return conduit communicating at second end with a reservoir through a means to impede fluid flow;

said means to impede fluid flow impeding the flow of coolant fluid communicated from said return conduit thereby increasing coolant fluid pressure in said pressurized coolant fluid circuit to a determined fluid pressure level;

said means to imped fluid flow venting said coolant fluid pressure substantially instantaneously to said reservoir once said determined fluid pressure level is reached thereby creating a surge of fluid through said coolant fluid circuit and said return conduit;

whereby pressurized fluid from said delivery conduit circulates through said coolant fluid circuit and exits through said return conduit to said reservoir in the first fluid circuit in one or a plurality of said surges of fluid to thereby purge said coolant fluid circuit containing gas or solids into said reservoir.

2. The fluid refilling and pressure testing apparatus of claim 1 wherein said means to pressurize said fluid supply is a pneumatically powered pump adapted for engagement with a compressed air supply system.

3. The fluid refilling and pressure testing apparatus of claim 2 additionally comprising:

a tank having a sidewall, a top wall, and a bottom wall, all defining said reservoir; and said pneumatically power pump mounted in said reservoir; and said fluid supply is communicated from said reservoir through said pneumatically powered pump to said second end of said delivery conduit thereby creating a closed loop system.

4. The fluid refilling and pressure testing apparatus of claim 3 additionally comprising:

a second fluid circuit;

means to switch between said first fluid circuit and said second fluid circuit; and said second fluid circuit bypassing said means to impede fluid flow, whereby fluid communicated through said return conduit communicates directly with said reservoir.

5. The fluid refilling and pressure testing apparatus of claim 4 additionally comprising:

a third fluid circuit;

means to switch between said first fluid circuit, said second fluid circuit, and said third fluid circuit; and said third fluid circuit bypassing said means to impede fluid flow and communicating fluid from said return conduit to a remote fluid container, said remote fluid container being separated from communication with said reservoir.

6. The fluid refilling and pressure testing apparatus of claim 3 additionally comprising:

a third fluid circuit;

means to switch between said first fluid circuit and said third fluid circuit; and said third fluid circuit bypassing said means to impede fluid flow and communicating fluid from said return conduit to a remote fluid container, said remote fluid container being separated from communication with said reservoir.

7. The fluid refilling and pressure testing apparatus of claim 2 additionally comprising:

a second fluid circuit;

means to switch between said first fluid circuit and said second fluid circuit; and said second fluid circuit bypassing said means to impede fluid flow, whereby fluid communicated through said return conduit communicates directly with said reservoir.

8. The fluid refilling and pressure testing apparatus of claim 7 additionally comprising:

a third fluid circuit;

means to switch between said first fluid circuit, said second fluid circuit, and said third fluid circuit; and said third fluid circuit bypassing said means to impede fluid flow and communicating fluid from said return conduit to a remote fluid container, said remote fluid container being separated from communication with said reservoir.

9. The fluid refilling and pressure testing apparatus of claim 2 additionally comprising:

a third fluid circuit;

means to switch between said first fluid circuit and said third fluid circuit; and said third fluid circuit bypassing said means to impede fluid flow and communicating fluid from said return conduit to a remote fluid container, said remote fluid container being separated from communication with said reservoir.

10. The fluid refilling and pressure testing apparatus of claim 1 additionally comprising a tank having a sidewall, a top wall, and a bottom wall, all defining said reservoir; and said fluid supply being communicated from said reservoir to said second end of said delivery conduit, thereby creating a closed loop system.

11. The fluid refilling and pressure testing apparatus of claim 10 additionally comprising:

a second fluid circuit;

means to switch between said first fluid circuit and said second fluid circuit; and said second fluid circuit bypassing said means to impede fluid flow, whereby fluid communicated through said return conduit communicates directly with said reservoir.

12. The fluid refilling and pressure testing apparatus of claim 11 additionally comprising:

a third fluid circuit;

means to switch between said first fluid circuit, said second fluid circuit, and said third fluid circuit; and said third fluid circuit bypassing said means to impede fluid flow and communicating fluid from said return conduit to a remote fluid container, said remote fluid container being separated from communication with said reservoir.

13. The fluid refilling and pressure testing apparatus of claim 10 additionally comprising:

a third fluid circuit;

means to switch between said first fluid circuit and said third fluid circuit; and said third fluid circuit bypassing said means to impede fluid flow and communicating fluid from said return conduit to a remote fluid container, said remote fluid container being separated from communication with said reservoir.

14. The fluid refilling and pressure testing apparatus of claim 1 additionally comprising:

a second fluid circuit;

means to switch between said first fluid circuit and said second fluid circuit; and said second fluid circuit bypassing said means to impede fluid flow, whereby fluid communicated through said return conduit communicates directly with said reservoir.

15. The fluid refilling and pressure testing apparatus of claim 14 additionally comprising:

a third fluid circuit;

means to switch between said first fluid circuit, said second fluid circuit, and said third fluid circuit; and said third fluid circuit bypassing said means to impede fluid flow and communicating fluid from said return conduit to a remote fluid container, said remote fluid container being separated from communication with said reservoir.

16. The fluid refilling and pressure testing apparatus for filling and pressure testing cooling systems of claim 14 additionally comprising:

said means to impede fluid flow concurrently providing a means to pressure test said cooling system for leaks.

17. The fluid refilling and pressure testing apparatus of claim 1 additionally comprising:

a third fluid circuit;

means to switch between said first fluid circuit and said third fluid circuit; and said third fluid circuit bypassing said means to impede fluid flow and communicating fluid from said return conduit to a remote fluid container, said remote fluid container being separated from communication with said reservoir.

18. The fluid refilling and pressure testing apparatus for filling and pressure testing cooling systems of claim 17 additionally comprising:

said means to impede fluid flow concurrently providing a means to pressure test said cooling system for leaks.

19. The fluid refilling and pressure testing apparatus for filling and pressure testing cooling systems of claim 1 additionally comprising:

said means to impede fluid flow concurrently providing a means to pressure test said cooling system for leaks.

20. A fluid refilling and pressure testing apparatus for filling and pressure testing cooling systems comprising:

a tank having a sidewall, a top wall, and a bottom wall, all defining said reservoir;

a first fluid circuit, said first fluid circuit comprising:

a delivery conduit adapted at a first end for sealed engagement with the pressurized coolant fluid circuit of an internal combustion engine;

said delivery conduit in sealed communication at a second end with a fluid supply;

means to pressurize said fluid supply communicated to said second end of said delivery conduit;

a return conduit adapted at a first end for sealed communication with said coolant fluid circuit;

said return conduit communicating at second end with said reservoir through a means to impede fluid flow;

said means to impede fluid flow impeding the flow of coolant fluid communicated from said return conduit thereby increasing coolant fluid pressure in said pressurized coolant fluid circuit to a determined fluid pressure level;

said means to imped fluid flow venting said coolant fluid pressure substantially instantaneously to said reservoir once said determined fluid pressure level is reached thereby creating a surge of fluid through said coolant fluid circuit and said return conduit;

a second fluid circuit, said second fluid circuit bypassing said means to impede fluid flow, whereby fluid communicated through said return conduit communicates directly with said reservoir;

a third fluid circuit, said third fluid circuit bypassing said means to impede fluid flow and communicating fluid from said return conduit to a remote fluid container, said remote fluid container being separated from communication with said reservoir; and means to switch between said first fluid circuit, said second fluid circuit, and said third fluid circuit, whereby fluid from said fluid supply can be pumped through said cooling system and be circulated through either of first fluid circuit, said second fluid circuit, or said third fluid circuit.

* * * * *